United States Patent [19]

Hartman

[11] Patent Number: 4,532,834

[45] Date of Patent: Aug. 6, 1985

[54] TWO-PIECE DRILL CHUCK WRENCH

[76] Inventor: Clyde H. Hartman, R.R. #1, Newton, Kans. 67114

[21] Appl. No.: 346,003

[22] Filed: Feb. 5, 1982

[51] Int. Cl.[3] ..... B25B 13/00

[52] U.S. Cl. ..... 81/16; 81/124.3; 81/176.1

[58] Field of Search ..... 279/1 K, 62; 408/241; 81/90 R, 90 A, 90 B, 90 C, 90 E, 121 B, 58.1, 3 R, 3.4, 3.44, 177 G

[56] References Cited

U.S. PATENT DOCUMENTS

| | | | |
|---|---|---|---|
| 1,681,881 | 8/1928 | Shaw | 81/177 G X |
| 2,472,716 | 6/1949 | Miller et al. | 81/90 C |
| 4,095,811 | 6/1978 | Cohen | 279/1 K |
| 4,222,293 | 9/1980 | Schreyer et al. | 81/90 B |

FOREIGN PATENT DOCUMENTS

| | | | |
|---|---|---|---|
| 133319 | 3/1960 | U.S.S.R. | 279/1 K |
| 848167 | 7/1981 | U.S.S.R. | 279/1 K |

*Primary Examiner*—Frederick R. Schmidt
*Assistant Examiner*—Debra S. Meislin
*Attorney, Agent, or Firm*—Edwin H. Crabtree

[57] ABSTRACT

A two-piece chuck wrench for receipt around a chuck body of a drill tool or the like. The wrench engaging beveled gear teeth of a ring gear around the top of a rotatably mounted chuck operating sleeve and engaging one of a plurality of bores in the side of the chuck body. The wrench is used for loosening and tightening tool engaging jaws in the chuck.

3 Claims, 5 Drawing Figures

TWO-PIECE DRILL CHUCK WRENCH

BACKGROUND OF THE INVENTION

This invention relates to a tool for loosening and tightening a drill shank in a drill tool and more particularly but not by way of limitation to a two-piece drill chuck wrench which is received around the chuck body of a drill tool and engaging a ring gear around the chuck body and one of the bores in the side of the chuck body.

Heretofore in the loosening and tightening of the tool engaging jaws of a standard drill tool a chuck key was used that engages the ring gear and one of the bores in the side of the chuck body. Quite often the chuck key was inadequate to sufficiently tighten the tool engaging jaws around the shank of a drill bit. Also after continued use the teeth of the chuck key became worn or stripped, making it difficult to engage the ring gear and change the drill bit. The subject invention eliminates the above mentioned problem.

In U.S. Pat. No. 898,657 to Kimball, U.S. Pat. No. 4,095,811 to Cohen, U.S. Pat. No. 4,222,293 to Schreyer et al, U.S. Pat. No. 3,651,719 to Wessel, U.S. Pat. No. 2,472,716 to Miller et al and U.S. Pat. No. 3,190,665 to Sztricsko various types of wrenches, tools and chuck keys are disclosed for loosening and tightening drill bits and the like. None of these devices have the unique features and advantages of the subject two-piece chuck wrench as described herein.

SUMMARY OF THE INVENTION

The two-piece chuck wrench is rugged in construction, simple in design, and can be adapted for various sizes of drill tools and the like having tool engaging jaws which are tightened around the shank of a drill bit.

The wrench is easy to use and engages the entire circumference of a ring gear around a chuck operating sleeve so the ring gear is properly engaged and rotated for tightening the jaws around the shank of the drill bit.

The invention provides a lower piece and an upper piece having handles which coact in giving the user of the wrench proper leverage in sufficiently tightening the shank of the drill bit inside the tool engaging jaws and the drill bit does not come loose during the operation of the tool.

The two-piece chuck wrench includes a lower piece having a first handle with a first circular head integrally formed in one end thereof. The first head has an opening therein for receipt around the chuck body. The first head has beveled teeth around the opening and is adapted for engaging the teeth of the ring gear surrounding the chuck body. An upper piece having a second handle with a second circular head integrally formed in one end thereof includes an opening in the circular head for receipt around the chuck body. The second head has a pin extending radially inward from the inner circumference of the second head. The pin is adapted for receipt in one of the bore holes in the side of the chuck body. By rotating the handles of the lower piece and the upper piece toward each other when engaging the ring gear and the bore inside the chuck body, the tool engaging jaws can be loosened and tightened around the shank of a drill bit or the like.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
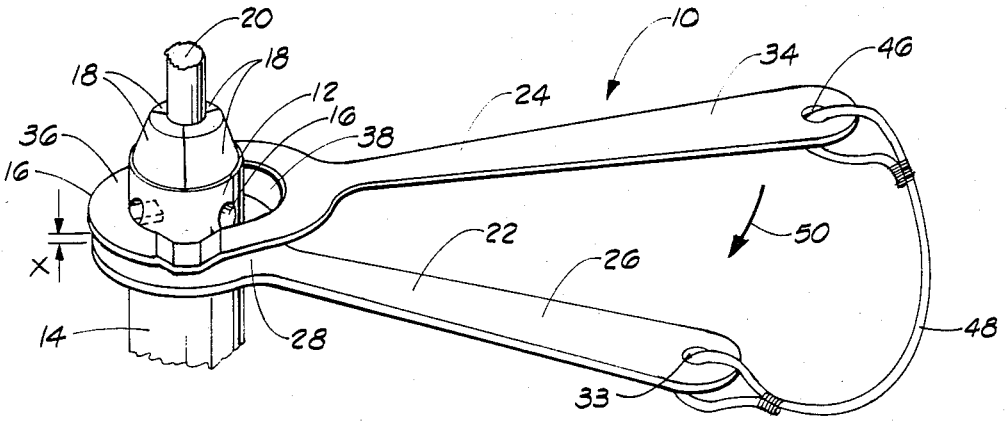
FIG. 1 is a perspective view of the two-piece drill chuck wrench received around a chuck body of a drill tool.

In FIG. 1 the two-piece drill chuck wrench is designated by general reference numeral 10. The wrench 10 is used for receipt around a chuck body 12 of a drill tool or the like. The drill tool is not shown in the drawings. The wrench 10 engages a ring gear around the top of a rotatably mounted chuck operating sleeve 14. The ring gear is not shown in the drawings since it is hidden by the wrench 10 resting thereon. In the side of the chuck body 12 are a plurality of bores 16 which are disposed in a spaced relationship around the circumference of the chuck body 12. Inside the chuck body 12 are tool engaging jaws 18 which by rotating the chuck operating sleeve 14 the jaws 18 are loosened and tightened around a drill shank 20 of a drill bit.

Figure 2:
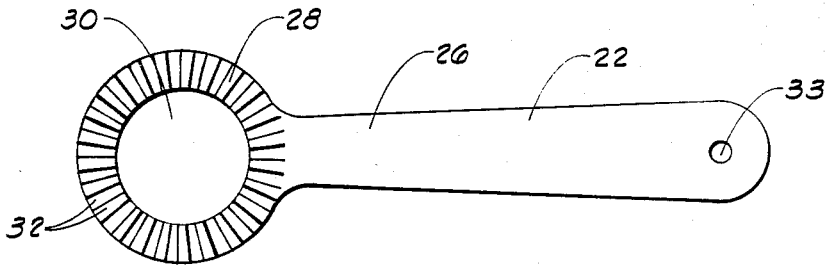
FIG. 2 is a bottom view of the lower piece of the chuck wrench.
Figure 3:
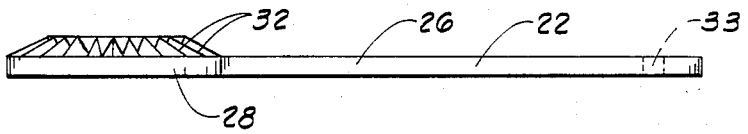
FIG. 3 is a side view of the lower piece.

Referring now both to FIG. 1 and FIGS. 2 through 5, the two-piece chuck wrench 10 includes a lower piece 22 and an upper piece 24. The lower piece 22 has a first handle 26 with a first circular head 28 integrally formed in one end thereof. The first head 28 has an opening 30 as shown in FIG. 2. The opening 30 is used for receipt around the chuck body 12 and includes beveled teeth 32 around the circumference of the opening 30 and adapted for engaging the teeth of the ring gear mounted around the top of the chuck operating sleeve 14. The lower piece 22 further includes an aperture 33 in the opposite end of the handle 26. In FIG. 3 a side view of the lower piece 22 can be seen with the beveled teeth 32 extending upwardly and around the opening 30 of the circular head 28.

Figure 4:
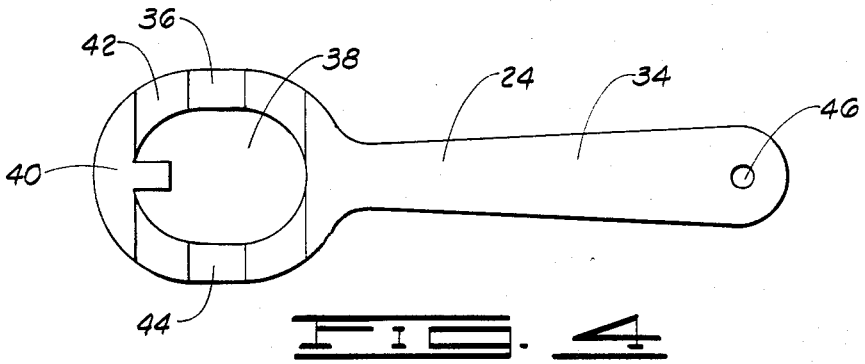
FIG. 4 is a bottom view of the upper piece of the chuck wrench.

The upper piece 24 includes a second handle 34 with a second circular head 36 integrally formed in one end thereof and having an opening 38 therein as shown in FIG. 1 and FIG. 4. The opening 38 is large enough for receipt around the chuck body 12 and includes a pin 40 extending radially inward from the inner circumference of the second head 36 and adapted for receipt in one of the bore holes 16 as shown in FIG. 1.

Figure 5:
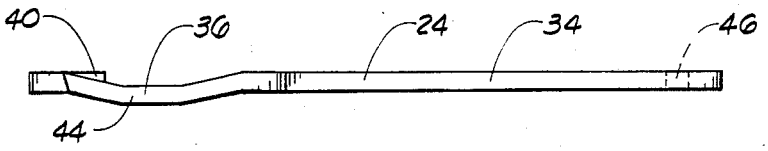
FIG. 5 is a side view of the upper piece.

In FIG. 5 a side view of the upper piece 24 can be seen wherein the opposite sides 42 and 44 are shown tapered downwardly so the circular head 36 of the upper piece 24 rests in a spaced relationship and shown as dimension "X" in FIG. 1. By tapering the opposite sides 42 and 44 of the second head 36, the spaced relationship dimension "X", allows the upper piece 24 to be rotated on top of the lower piece 22 without the handles 26 and 34 contacting each other.

The upper piece 24 further includes an aperture 46 in the opposite end of the handle 34. The two apertures 33 and 46 receive the opposite ends of a flexible cord 48 with the ends of the cord 48 secured to the ends of the handles. The cord 48 prevents the lower piece 22 and the upper piece 24 from being separated when the two-piece chuck wrench 10 is not in use.

It should be noted in FIG. 1 the lower piece 22 is first received around the chuck body 12 with the beveled teeth 32 engaging the top of the ring gear of the chuck operating sleeve 14. The upper piece 24 is then received around the chuck body 12 with the tapered sides 42 and 44 of the circular head 36 received on top of the first circular head 28 with the pin 40 inserted in one of the bores 16 in the side of the chuck body 12. The upper piece 24 is then rotated in a clockwise direction as indicated by arrow 50 with the lower piece 22 held in place. Because of the leverage provided by the handles 26 and 34 the chuck body 12 is easily rotated in a clockwise direction with the chuck operating sleeve 14 held in place thereby loosening the tool engaging jaws 18 around the drill shank 20. Likewise, by placing upper piece 24 to the left of the lower piece 22, the upper piece 24 then can be rotated in a counter clockwise direction toward the lower piece 22 for tightening the jaws 18 around the drill shank 20.

Changes may be made in the construction and arrangement of the parts or elements of the embodiments as described herein without departing from the spirit or scope of the invention defined in the following claims.

What is claimed is:

1. A two-piece chuck wrench for receipt around a chuck body of a drill tool or the like, the wrench engaging beveled gear teeth of a ring gear around a top of a rotatably mounted chuck operating sleeve and engaging one of a plurality of bores in the side of the chuck body, the wrench loosening and tightening tool-engaging jaws in the chuck body, the wrench comprising:

a lower piece having a first handle with a first circular head integrally formed in one end thereof, the first head having an opening therein for receipt around the chuck body, the first head having beveled teeth around the opening and adapted for engaging all of the beveled gear teeth of the ring gear; and an upper piece having a second handle with a second circular head integrally formed in one end thereof, the second head having an opening therein for receipt around the chuck body, the second head having a pin extending radially inward from the inner circumference of the second head, the pin adapted for receipt in one of the bore holes;

the bottom of the second head of the upper piece rests on the top of the first head of the lower piece and pivots thereon when loosening and tightening the tool engaging jaws; and wherein opposite sides of the second head of the upper piece are tapered downwardly so the upper piece rests in a spaced relationship above the lower piece when loosening and tightening the tool engaging jaw.

2. The wrench as described in claim 1 further including apertures in the opposite ends of the first and second handles for receiving a flexible cord, the ends of the cord secured to the handles.

3. A two-piece chuck wrench for receipt around a chuck body of a drill tool or the like, the wrench engaging a beveled gear teeth of a ring gear around the top of a rotatably mounted chuck operating sleeve and engaging one of a plurality of bores in the side of the chuck body, the wrench loosening and tightening tool engaging jaws in the chuck body, the wrench comprising:

a lower piece having a first handle with a first circular head integrally formed in one end thereof, the first head having an opening therein for receipt around the chuck body, the first head having beveled teeth around the opening and adapted for engaging all of the beveled gear teeth of the ring gear;

an upper piece having a second handle with a second circular head integrally formed in one end thereof, the second head having an opening therein for receipt around the chuck body, the second head having a pin extending radially inward from the inner circumference of the second head, the pin adapted for receipt in one of the bore holes, opposite sides of the second head of the upper piece are tapered downwardly so the upper piece rests on the lower piece and pivots thereon when loosening and tightening the tool engaging jaws; and apertures in the opposite ends of the first and second handles for receiving a flexible cord, the ends of the cord secured to the handles.

* * * * *